United States Patent [19]

Ernst

[11] 4,354,668

[45] Oct. 19, 1982

[54] METHOD AND APPARATUS FOR DETERMINING COMPLETION OF A CAST IN BLAST FURNACE CASTHOUSE POLLUTION SUPPRESSION SYSTEM

[75] Inventor: Donald M. Ernst, Chicago, Ill.

[73] Assignee: Jones & Laughlin Steel Incorporated, Pittsburgh, Pa.

[21] Appl. No.: 294,663

[22] Filed: Aug. 20, 1981

[51] Int. Cl.[3] ..... C21B 7/12; B22D 39/00

[52] U.S. Cl. ..... 266/45; 222/590; 222/591; 266/99; 266/158

[58] Field of Search ..... 266/158, 45, 99, 92–94, 266/87, 88, 236, 271, 272, 144, 159; 222/590, 591, 594, 585, 56; 164/337, 150, 154; 75/41, 42

[56] References Cited

U.S. PATENT DOCUMENTS

| | | | |
|---|---|---|---|
| 3,994,210 | 11/1976 | Davis | 98/115 R |
| 4,019,563 | 4/1977 | Bergman et al. | 164/155 |
| 4,245,820 | 1/1981 | Muryn | 266/158 |

FOREIGN PATENT DOCUMENTS

| | | | |
|---|---|---|---|
| 7113332 | 10/1972 | France . | |
| 539941 | 12/1977 | U.S.S.R. . | |
| 583162 | 12/1977 | U.S.S.R. | 266/197 |

OTHER PUBLICATIONS

Nicola, A. G., "Blast Furnace Cast House Emission Control", *Iron and Steel Engineer,* pp. 33–39, Aug. 1979.

*Primary Examiner*—L. Dewayne Rutledge
*Assistant Examiner*—Christopher W. Brody
*Attorney, Agent, or Firm*—John Stelmah

[57] ABSTRACT

Method and apparatus for determining when the cast of a blast furnace is substantially completed in a blast furnace cast system wherein direct viewing of the taphole is obstructed during the cast. In a system wherein viewing of the taphole is obstructed by hood means covering the iron trough, substantial completion of the cast may be determined by sensing changes in ambient conditions, e.g., a change in temperature within the hood means, vibration of the hood, and/or a change in the color of the flame generated at the discharge end of a slag runner.

8 Claims, 7 Drawing Figures

METHOD AND APPARATUS FOR DETERMINING COMPLETION OF A CAST IN BLAST FURNACE CASTHOUSE POLLUTION SUPPRESSION SYSTEM

BACKGROUND OF THE INVENTION

1. Field of the Invention

This invention relates to steel mill blast furnace casthouses which employ controls for the suppression of fume formation and more particularly to those systems which employ hoods which cover the blast furnace taphole during casting.

When the taphole is covered by a hood it is not possible to directly sight the taphole to observe when the molten material ceases to flow as a stream from the furnace, which indicates the end of the cast. At the end of the cast it is necessary to remove the hood in order to make room for the mudgun to be swung into position for plugging the taphole. It is important to be able to sense, or anticipate, when the cast is completed in order to deter checking of the furnace and to minimize any deterioration of the hood which might occur.

2. Description of Prior Art

The present invention is ancillary to the invention disclosed and claimed in pending U.S. patent application Ser. No. 190,130 (filed Sept. 24, 1980), which is owned by the assignee of the invention described in this application and is incorporated by reference herein.

U.S. patent application Ser. No. 190,130 describes method and apparatus for the suppression and mitigation of fumes from iron troughs and iron and slag runners of blast furnace casting systems. There it is disclosed that the known prior art fume pollution control systems are addressed to the ventilation or exhausting of fumes after they are formed, primarily by circulating air to function as a carrier and coolant of the fumes before collection in a baghouse, or the like. In contrast, application Ser. No. 190,130 is addressed to minimizing the causal effects, i.e., the formation of fumes due to oxidization of the iron, slag, and sulfur, by occluding oxidizing gases, primarily through the use of hoods or covers on the iron trough and the iron and slag runners.

It is believed there are no other presently known blast furnace casthouse pollutant control systems which cover the taphole with hoods without drafting air.

SUMMARY OF THIS INVENTION

It is a primary object of this invention to enhance the operation of the blast furnace casthouse pollutant suppression system described in U.S. application Ser. No. 190,130 by providing method and apparatus for indicating when the cast is completed, or nearly completed, in a blast furnace which utilizes such a pollutant suppression system.

It is another object of this invention to provide method and apparatus for detecting the near completion or completion of a cast in a blast furnace which furnace includes a hood covering its taphole.

In most prior art blast furnace casthouse pollutant venting systems the taphole of the furnace is left exposed so that it is clearly visible by a furnace operator and he can observe when a cast is finished by the nature of the stream of molten material being discharged through the taphole. Near the end of the cast the stream does not fill the entire cross-section of the tap hole. When this occurs the operator prepares to close the taphole by means of clay or mud forced from a gun positioned with its nose in the taphole.

A feature of the present invention is the discovery that in a blast furnace pollutant suppression system which includes hood or cover means for occluding ambient air from the iron trough and the taphole the temperature under the covers will first plateau and then subsequently begin to rise before the end of a cast from the furnace, i.e., before the furnace is dry. As the stream of molten material flowing through the taphole becomes smaller to the extent it does not completely fill the transverse cross-section of the taphole some of the wind or blasting gases from within the furnace will discharge through the taphole. Since the temperature of these gases is greater than that of the molten material as the gases enter the hoods, the temperature within the hoods will rise above the plateau temperature. It has also been observed that the flow of the blasting gases into the space beneath the hood covers will be manifested by a slight vibration of the hood covering the taphole. It has been further observed that during the cast at the uncovered discharge end of a slag runner there is a distinctive yellow flame, however, as the hot gases escape from the blast furnace through the taphole and through the covered slag runners the flame at the end of the slag runner changes color, i.e., it becomes more white. It is believed that this change in color is due to more complete combustion of the gases brought about by higher temperatures and richer gases.

It is important for the hood to be removed from the taphole and for the taphole to be plugged as soon as possible after the blast furnace is cast dry in order to minimize the need for cutting back the wind in the furnace and to minimize lost time toward processing the next cast and damage to the furnace and the auxiliary equipment. Excessive circulation of the blast furnace gases within the hoods could lead to premature erosion of the refractory insulation in the hoods because of the scrubbing action of the gases. Also, if the furnace is "overblown" solid coke may be blown out through the taphole and disrupt continued operations until such time the coke can be cleared away.

DESCRIPTION OF PREFERRED EMBODIMENTS

Figure 1:
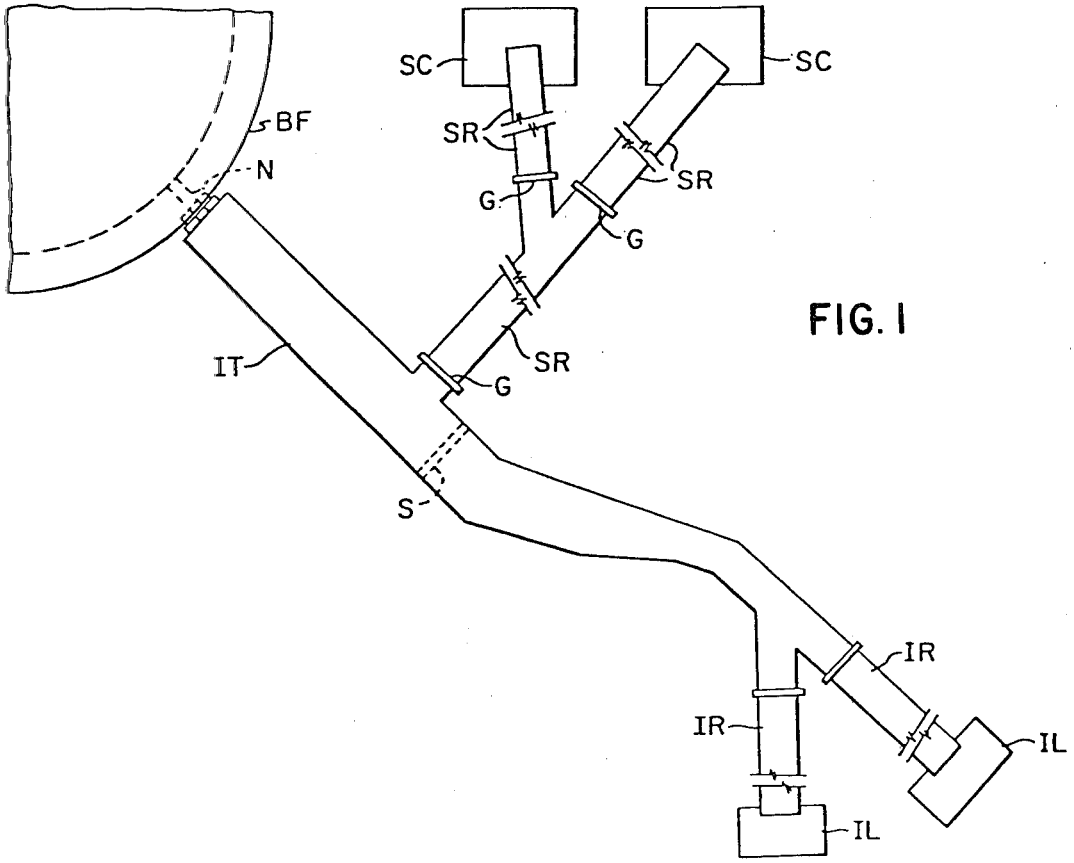
FIG. 1 is a schematic representation in plan view of a typical blast furnace and runner system.
Figure 2:
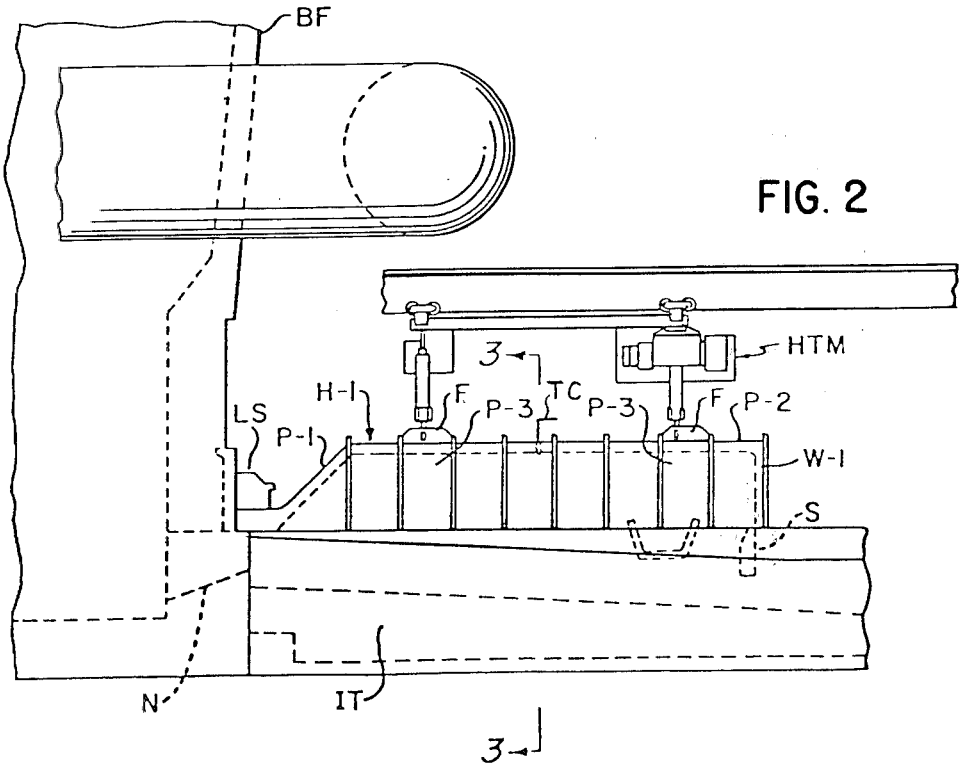
FIG. 2 is a side elevational view of a fragmentary portion of a blast furnace and an iron trough together with an enclosure for the iron trough.
Figure 3:
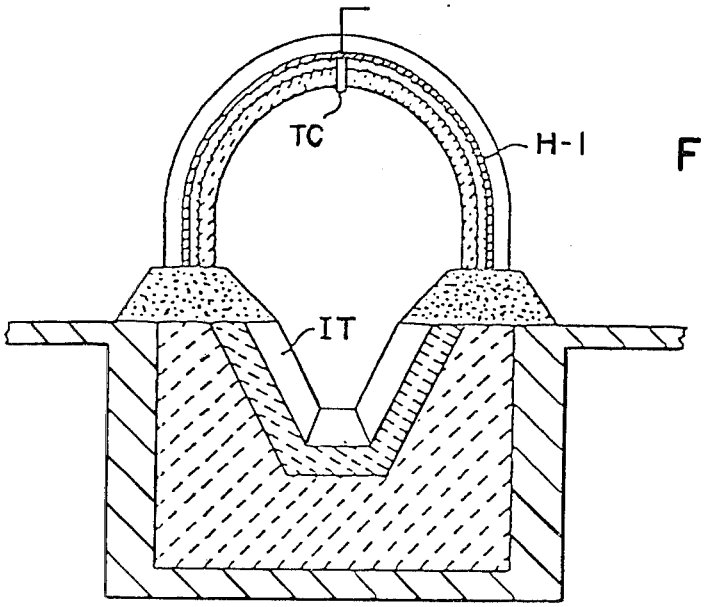
FIG. 3 is a cross-sectional view taken along line 3—3 of FIG. 2.
Figure 4:
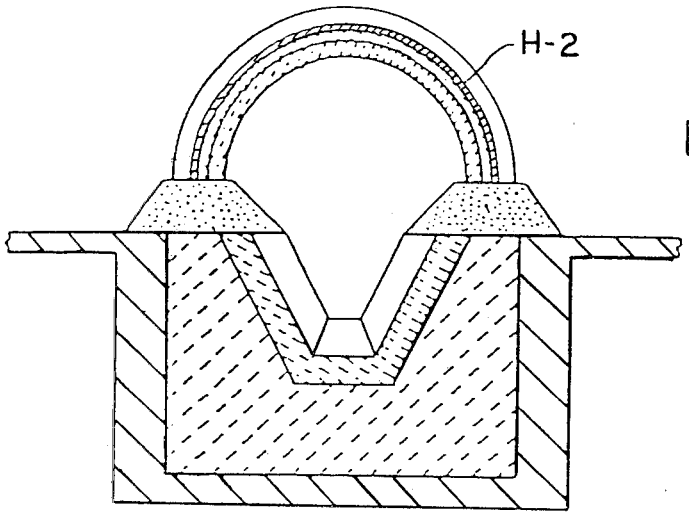
FIG. 4 is a cross-sectional view of a runner and hood.

In a typical embodiment of this invention as illustrated in FIG. 2, the blast furnace and the discharge notch are generally designated by the reference characters BF and N, respectively. The molten material, comprising iron and slag, is tapped from the furnace BF through the notch N which defines the taphole and extends downwardly from the outside of the furnace through the water cooled hearth jacket toward the hearth. The notch N is plugged after each cast with a clay mixture forced into the notch hole under pressure by means of a mudgun (not shown) which is latched onto latch support LS. As the notch N is opened at the beginning of a cast, the molten material flows out into a large trough IT, generally referred to as an iron trough, which serves to hold the molten material for a sufficient time to allow the iron and slag to separate. There is skimmer means S at the end of the trough IT which serves to skim off the slag from the molten iron settled in the bottom of the trough IT. The skimmer means S in some systems is followed by a dam (not shown) which serves to help maintain the level of the molten iron higher than the bottom of the skimmer plate. At the skimmer S there is a dam and an arrangement of gates G and runners SR to carry off the slag S to slag collector means SC, such as a slag pot or a large pit. The iron flowing under the skimmer plate and over the iron dam runs down troughs IR, commonly referred to as iron runners, which are also fitted with gates G to selectively divert the flow to each of several iron ladles IL. At the end of a cast or tapping, the mudgun is placed in position to plug the taphole with clay. It is at this stage that special provision must be made to handle the section of enclosure surrounding the taphole in order to provide access by the mud gun to the taphole. It is also at this stage that the method and apparatus of this invention finds particular application.

There is provided immediately adjacent to the blast furnace BF a hood H-1 which covers the iron trough. It is preferred to provide separate hoisting and transport mechanism, generally designated by the reference HTM, for lifting and moving the hood H-1 away from the tap hole in preparation for the drilling and plugging procedures. The hood H-1 is comprised of several panel sections P which are joined together, such as by welding the upturned edges of the outer casings which form stiffening flanges. The section P-1 has a slanted top tapered toward the blast furnace and terminating in a nose portion to provide an end closure which will also accommodate positioning of the hood H-1 beneath the clay gun support LS. The opposite end section P-2 has a vertical wall portion W-1 to likewise provide an end closure. Each of the sections P are provided with insulation to protect the metal cover.

The hoods H-2 are provided to enclose the iron runners IR and the slag runners SR. The hoods H-2 may be similar in construction as hood H-1 or they be simply flat plates similarly lined with insulation.

In accordance with the preferred embodiment of this invention there is provided within the hood means, most preferably within hood H-1, a thermocouple TC for sensing the temperature within the hood and generating an electrical impulse representative of the sensed temperature. The electrical impulse is received by temperature recording and comparator means CM. In some cases the temperature recording section may be omitted. The comparator means CM may be of the type wherein a set point may be adjustably preselected to correspond to that temperature at which it is desired to generate a signal for activating indicia means IM which provides an indication, visual or audible, when the preset temperature point and the sensed temperature correspond to each other.

It has been observed during trials that each hood system displays a characteristic temperature profile during a cast, which temperature profile is useful toward anticipating the end of the cast. The sensed temperatures may vary from one system to another because of variations in the hood structures, positioning of the thermocouple within the hood, composition of the melt, etc. In any event, as observed from FIGS. 6 and 7, there develops a characteristic temperature curve which corresponds generally to the time the wind from the blast furnace starts to pass through the taphole into the hood until the blast furnace is dry-cast. In order to establish a temperature profile for a system it is necessary to purposely run the furnace dry for several casts. Thereafter, the approximate time that the furnace would otherwise run dry can be anticipated and the cast cut short by removing the hood and plugging the taphole. The amount of time required will of course be contingent upon the percentage of the total molten metal available the operator wishes to be cast, the type and efficiency of the equipment used to remove the hood away from the taphole and of that used to plug the tap- hole, as well as upon the experience of the blast furnace personnel.

Figure 6:
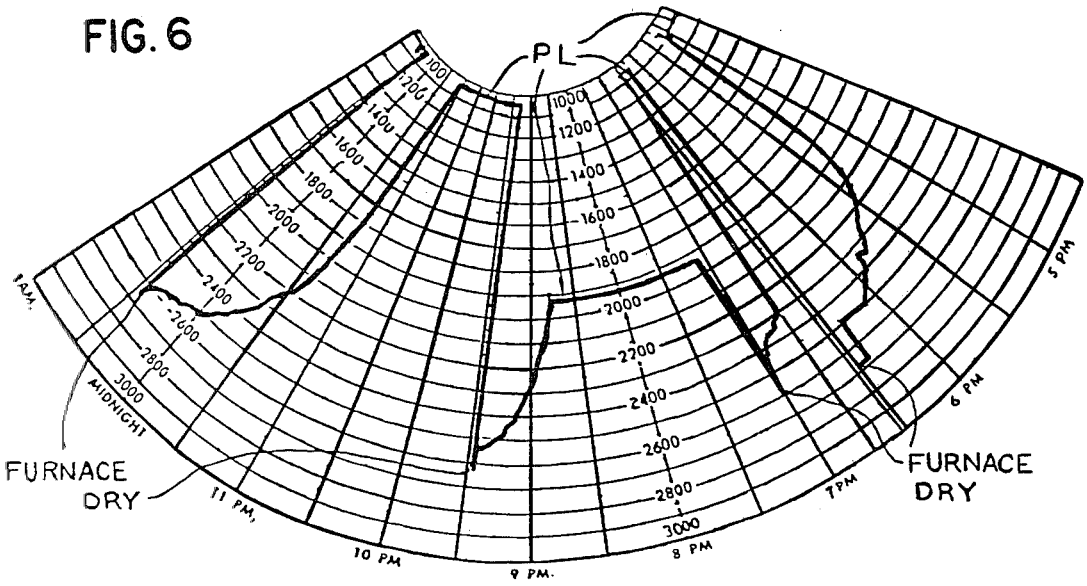
FIG. 6 is a reproduction of a fragmentary portion of a circular temperature chart generated by a blast furnace operation during four casts.

The method of this invention may be further illustrated by reference to FIG. 6 wherein the hood temperature curves were developed on a circular type recorder. The temperature curves show that the temperature inside the hood began to sharply increase from a plateau PL, then to deviate or slope away from a generally straight line increase at a temperature of about 1900 deg. F., ±100 deg. F., and then to peak at about 2600 deg. F., ±100 deg. F. In a system which displays such a hood temperature profile the furnace operator might opt for a comparator set point of 2500 deg. F. to signal the approach of the otherwise dry furnace temperature of about 2600 deg. F., to provide sufficient time for the hood to be removed away from the taphole and for the taphole to be plugged before the furnace is cast fully dry.

Figure 7:
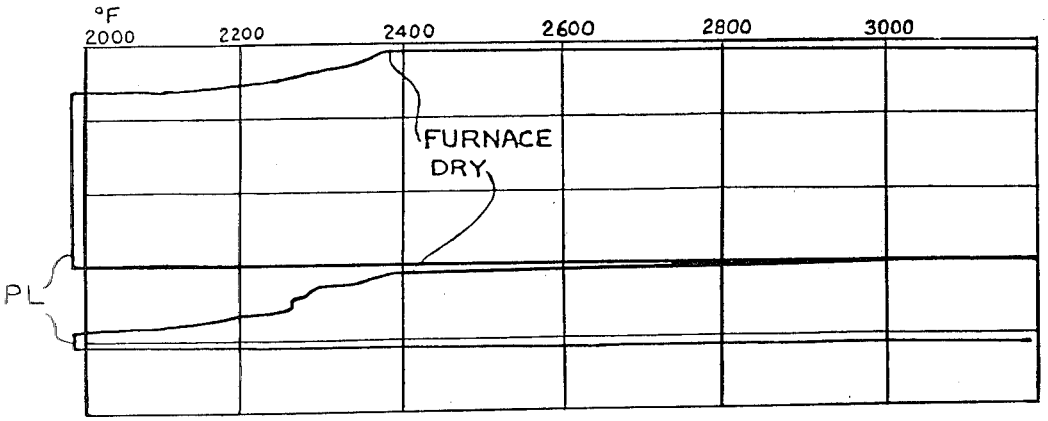
FIG. 7 is a reproduction of a fragmentary portion of a cylindrical type temperature chart generated by another blast furnace operation during two casts, the chart travel being in a downward direction in respect to the drawing sheet.

The temperature curves in FIG. 7 were produced in conjunction with another blast furnace on a cylindrical type recorder. There the temperatures below 2000 deg. F. were not recorded. However, it can be seen that temperatures inside the hoods began to increase from a plateau PL (off the chart) at about 2000 deg. F. and then to peak at about 2400 deg. F. In a system which displays a temperature profile such as this, the blast furnace operator might opt for a set point of 2300 deg. F.

In the most preferred embodiment of this invention, the characteristic temperature profile of a blast furnace hood covering a tap hole is developed by purposely running the furnace dry for several taps. The developed profile will display a range wherein the temperature inside the hood will suddenly rise and then generally peak at the point which corresponds to that when the furnace is dry. The point corresponding to that at which the temperature starts to rise will generally correspond to that temperature attained in the hood when the hot blast from the blast furnace starts to enter the hood. After the characteristic temperature profile is developed, the furnace operator arbitrarily selects that temperature for which an indicia signal is desired. This temperature will be contingent upon the operator's experience and his judgment of the efficiency of his aides, of the hood handling equipment, and of the taphole plugging equipment. As an optimum, he will select that temperature as a set point for removing the hood which will provide time for casting the maximum molten material from the furnace but short of running the furnace dry to the point where the hot blast air in the blast furnace must be cut back. Optionally, a pre-alert signal may be provided in addition to the signal indicating the approach of the dry furnace temperature. Such pre-alert signal might be selected to correspond to the average temperature (based on past history) at which the temperature in the hood first starts to change from the plateau temperature.

Figure 5:
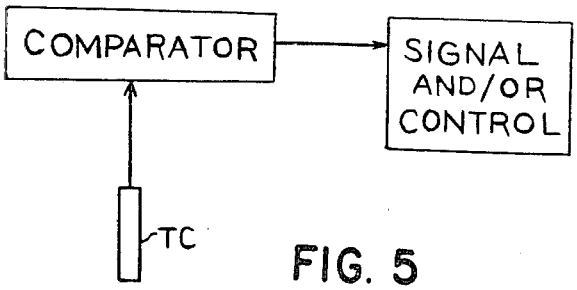
FIG. 5 is a block diagram of the temperature sensing and signal emitting means of the signal generation circuit of this invention.

The operation of a circuit, such as shown in FIG. 5, for generating the indicia signal and/or control will now be described.

The operator selects a set point on the comparator corresponding to the temperature at which he wishes a signal. The comparator does not actually compare temperatures but instead compares the voltage generated by the thermocouple TC with the set point voltage representative of the selected temperature. When the voltage generated by the thermocouple TC matches the set point voltage the comparator will generate a second voltage which will actuate an alarm, or other indicia means, visual or audio. Optionally, the second voltage may be employed to actuate control means for controlling the hood hoisting and transport mechanism HTM. In the event the mechanism HTM is so actuated, manual override means should be provided for safety reasons.

In the event there should occur a failure in the preferred temperature sensing procedure described above the time at which the furnace starts to run dry can be sensed by observing any intensity change in the vibration of the hood means. Such vibration can be sensed by placing a gloved hand on the hood. It is believed that such vibration is probably due to the large volume of gases passing from the blast furnace and passing through to the hood wherein the gases pick up light portions of slag and propel the slag against the wall of the hood. As the molten level in the furnace lowers the intensity of the vibration will increase.

Another alternative way of sensing when the gases from the blast furnace start passing through tap hole or notch is to observe the flame formed at the discharge end of a slag runner. As the hot gases, which usually include carbon monoxide and hydrogen, pass through the hoods there occurs a breakdown in the hydrocarbons such that when they combine with the air at the end of the hooded slag runners combustion is more complete and at high temperatures and produce flame which is whiter than that produced before the enriched hot gases pass through the taphole.

It is claimed:

1. A method of operating a blast furnace having a hood covering its taphole during casting, which method comprises:

sensing, with the hood in place, when the level of molten material does not fill the vertical cross-section of the taphole; and removing said hood before the furnace casts dry.

2. The method as described in claim 1, wherein:

said sensing comprises monitoring the temperature inside the hood and observing when said temperature rises from that corresponding to that when gases are not passing from said furnace through said taphole into said hood.

3. The method as described in claim 1, wherein:

said sensing comprises observing a change in color of the flame emitted from the end of a slag runner.

4. The method as described in claim 1, wherein:

said sensing comprises observing an intensity change in the vibration of said hood.

5. A method of operating a blast furnace having a hood covering its taphole, which method comprises:

(a) measuring and recording the temperature inside said hood;

(b) purposefully casting said furnace dry during a number of casts to provide a temperature profile for said hood in conjunction with said blast furnace, (1) said profile including a representative plateau temperature range inside said hood reached during full flow of molten material through said taphole (2) said profile also including a representative dry-cast temperature range in said hood reached when said blast furnace is cast dry; and (c) removing said hood during subsequent castings of said blast furnace when the temperature inside said hood is above a plateau temperature in said profile and below a dry-cast tap temperature in said profile.

6. The method as described in claim 5, wherein:

said hood is removed in step (c) when the temperature inside the hood reaches a point along the slope of a temperature curve of said profile.

7. The method as described in claim 5, which further comprises:

preselecting a temperature below said dry-cast temperature range desirable for alerting the approach of the dry-cast temperature range; and generating a signal when the preselected temperature inside hood is reached.

8. The method as described in claim 5, wherein:

said hood is removed in step (c) immediately after said dry-cast temperature is reached.

* * * * *